US009976220B2

(12) United States Patent
Hu et al.

(10) Patent No.: US 9,976,220 B2
(45) Date of Patent: May 22, 2018

(54) PROTECTING THE SURFACE OF A LIGHT ABSORBER IN A PHOTOANODE

(71) Applicant: The California Institute of Technology, Pasadena, CA (US)

(72) Inventors: Shu Hu, Pasadena, CA (US); Nathan S. Lewis, La Canada Flintridge, CA (US)

(73) Assignee: California Institute of Technology, Pasadena, CA (US)

( * ) Notice: Subject to any disclaimer, the term of this patent is extended or adjusted under 35 U.S.C. 154(b) by 493 days.

(21) Appl. No.: 14/512,248

(22) Filed: Oct. 10, 2014

(65) Prior Publication Data

US 2015/0101664 A1 Apr. 16, 2015

Related U.S. Application Data

(60) Provisional application No. 61/889,430, filed on Oct. 10, 2013.

(51) Int. Cl.

| | |
|---|---|
| ***C25B 9/00*** | (2006.01) |
| ***C25B 1/00*** | (2006.01) |
| ***C25B 11/04*** | (2006.01) |

(52) U.S. Cl.

CPC ..... *C25B 1/003* (2013.01); *C25B 11/04* (2013.01)

(58) Field of Classification Search

CPC ..... C25B 1/003; C25B 9/00; Y02P 70/521
USPC ..... 204/193
See application file for complete search history.

(56) References Cited

U.S. PATENT DOCUMENTS

| | | | | |
|---|---|---|---|---|
| 2008/0223439 | A1 | 9/2008 | Deng et al. | |
| 2009/0215276 | A1 | 8/2009 | Vereecken et al. | |
| 2010/0133111 | A1 | 6/2010 | Nocera et al. | |
| 2012/0216854 | A1 | 8/2012 | Chidsey et al. | |
| 2012/0309126 | A1* | 12/2012 | Shin | H01G 9/209 438/69 |
| 2013/0256147 | A1* | 10/2013 | Lewis | C25B 1/003 205/340 |

FOREIGN PATENT DOCUMENTS

WO 2011125024 A1 10/2011

OTHER PUBLICATIONS

Baharlou, Simin, International Preliminary Report on Patentability, PCT/US2014/060167, The International Bureau of WIPO, dated Apr. 21, 2016.
Kim, Do Weon, International Search Report and Written Opinion, PCT/US2014/060167, Korean Intellectual Property Office, dated Jan. 26, 2015.

* cited by examiner

*Primary Examiner* — Zulmariam Mendez
(74) *Attorney, Agent, or Firm* — Gavrilovich, Dodd & Lindsey LLP

(57) ABSTRACT

A photoanode includes a passivation layer on a light absorber. The passivation layer is more resistant to corrosion than the light absorber. The photoanode includes a surface modifying layer that is location on the passivation layer such that the passivation layer is between the light absorber and the surface modifying layer. The surface modifying layer reduces a resistance of the passivation layer to conduction of holes out of the passivation layer.

20 Claims, 9 Drawing Sheets

PROTECTING THE SURFACE OF A LIGHT ABSORBER IN A PHOTOANODE

CROSS REFERENCE TO RELATED APPLICATIONS

This Application claims the benefit of U.S. Provisional Patent Application Ser. No. 61/889,430, filed on Oct. 10, 2013, and incorporated herein in its entirety.

STATEMENT REGARDING FEDERALLY SPONSORED RESEARCH

This invention was made with government support under DE-SC0004993/T-106372 awarded by the Department of Energy. The government has certain rights in the invention.

FIELD OF THE INVENTION

The invention relates to photoanodes, and more particularly, to protection of the light absorbers included in photoanodes.

BACKGROUND

Photoanodes are used in a variety of applications such as solar fuel generators. Photoanodes include a light absorber that absorbs light such that an electron-hole pair is excited within the light absorber. The holes are transported to surface of the light absorber where they can react with a component of the environment in which the photoanode is placed. However, photoanodes are often used in a basic environment. For instance, photoanodes used to oxidize water in solar fuel generators are often in a basic or strongly basic environment during operation of the solar fuel generator. This environment can damage and/or corrodes the semiconductor included in the photoanode. As a result, there is a need for photoanodes that can tolerate the oxidative conditions in which photoanodes are used.

SUMMARY

A photoanode includes a passivation layer on a light absorber. The passivation layer is more resistant to corrosion than the light absorber. The photoanode also includes a surface modifying layer on the passivation layer such that the passivation layer is between the light absorber and the surface modifying layer. The surface-modifying layer reduces the resistance of the passivation layer to conduction of holes out of the passivation layer.

The disclosure provides a device, comprising a photoanode that includes a passivation layer on a light absorber, the passivation layer being more resistant to corrosion than the light absorber; and the photoanode including a surface modifying layer on the passivation layer such that the passivation layer is between the light absorber and the surface modifying layer, the surface modifying layer reducing a resistance of the passivation layer to conduction of holes out of the passivation layer. In one embodiment, the modifying layer and surface modifying layer are selected such that application of a voltage across the surface modifying and passivation layer so as to generate an anodic current through both the surface modifying layer and the passivation layer results in anodic current density that is higher for the modifying layer and the passivation layer than would result for application of the same voltage across the passivation layer without the surface modifying layer being on the passivation layer. In a further embodiment, when the applied voltage is 0.3 V vs. SCE, the anodic current density for the combination of the surface modifying layer and the passivation layer is at least 10 mA/cm$^2$ higher than the current density for the passivation layer alone. In yet another embodiment, when the applied voltage is 0.3 V vs. SCE, the anodic current density for the combination of the surface modifying layer and the passivation layer is at least 30 mA/cm$^2$ higher than the current density for the passivation layer alone. In another embodiment, the application of the 0.03 V across the passivation layer without the surface modifying layer being on the passivation layer results in an anodic current density of 0 mA/cm$^2$. In another embodiment, the surface modifying layer is in ohmic contact with the passivation layer. In yet another embodiment, a material for the surface modifying layer mixes with the material of the passivation layer at an interface of the surface modifying layer and the passivation layer, the intermixing being such that at a distance of 3 nm into the passivation layer the molar % of the passivation layer that is the material for the surface modifying layer is at least 20%. In another embodiment, the passivation layer includes a metal oxide. In another embodiment, the passivation layer includes one or more components selected from a group consisting of $TiO_2$, $SrTiO_3$, $SnO_2$, $K_2Ti_2O_5$, $K_2Ti_4O_9$, $BaTiO_3$, $PbTiO_3$, $ZrO_2$, $HfO_2$, $SnO_2$, $In_2O_3$, $FeO_x$, $MnO_x$, $NiO_x$, $CoO_x$, $WO_3$, ZnO, $Ta_2O_5$, $NbO_x$, $Al_2O_3$, MgO, $SiO_2$, and $BiO_x$ where x is greater than or equal to 1 and/or less than or equal to 2. In yet another embodiment, the surface modifying layer includes one or more components selected from the group consisting of elemental Ni, Co, Fe, Mn, Au, Ag, Ir, Ru, Rh, W, and Ti; oxides that include one or more items selected from the group consisting of Ni, Co, Fe, Mn, Au, Ag, Ir, Ru, Rh, W, and Ti; nitrides that include one or more items selected from the group consisting of Ni, Co, Fe, Mn, Au, Ag, Ir, Ru, Rh, W, and Ti; and oxynitrides that include one or more items selected from the group consisting of Ni, Co, Fe, Mn, Au, Ag, Ir, Ru, Rh, W, and Ti. In still another embodiment, an oxidation catalyst is on the surface modification layer such that the surface modification layer is between the oxidation catalyst and the passivation layer. In a further embodiment, the oxidation catalyst includes one or more components selected from the group consisting of elemental Ni, Co, Fe, Mn, Ir, Ru, Rh, Ta, W, and Ti; oxides that include one or more items selected from the group consisting of Ni, Co, Fe, Mn, Ir, Ru, Rh, Ta, W, and Ti. In another embodiment, the surface modification layer is positioned on a surface of the passivation layer such that the surface modification layer is not positioned on portions of the surface. In a further embodiment, the surface modification layer is arranged in discrete islands on the passivation layer. In still a further embodiment, the islands have a diameter dimension that is in a range of 11 nm to 100 μm, an average separation between the islands is in a range of 10 nm to 500 μm, and a thickness of each island of 1 nm-2 μm, the dimension being selected from the group consisting of the width, length, and diameter. In another embodiment, an aspect-ratio for the light-absorber is in a range of 5:1 to 200:1. In another embodiment, the photoanode is included in a solar fuels generator. In another embodiment, the photoanode is immersed a liquid with a basic pH. In yet another embodiment, the passivation layer is arranged on the light absorber such that an environment in which the photoanode is located does not directly contact the light absorber. In another embodiment, the passivation layer conducts holes through defect mediated conduction.

DETAILED DESCRIPTION

As used herein and in the appended claims, the singular forms "a," "and," and "the" include plural referents unless the context clearly dictates otherwise. Thus, for example, reference to "an anode" includes a plurality of anodes and reference to "the layer" includes reference to one or more layers known to those skilled in the art, and so forth.

The term "about" or "approximately" means an acceptable error for a particular value, which depends in part on how the value is measured or determined. In certain embodiments, "about" can mean 1 or more standard deviations.

Unless defined otherwise, all technical and scientific terms used herein have the same meaning as commonly understood to one of ordinary skill in the art. Although there are additional methods and reagents similar or equivalent to those described herein, the exemplary methods and materials are presented herein.

All publications mentioned herein are incorporated herein by reference in full for the purpose of describing and disclosing the methodologies, which might be used in connection with the description herein. Moreover, with respect to any term that is presented in one or more publications that is similar to, or identical with, a term that has been expressly defined in this disclosure, the definition of the term as expressly provided in this disclosure will control in all respects.

A photoanode includes a light absorber and a passivation layer located between the light absorber and the environment in which the photoanode is positioned. The passivation layer can be more resistant to corrosion than the light absorber and can accordingly protect the light absorber from corrosion. As a result, holes generated within the light absorber must be transported across the passivation layer in order to react with components of the anode environment. Many materials that are desirable for use as the passivation layer have a barrier to the holes moving across the surface of the passivation layer into the anode environment. As a result, these materials have a very high level of resistance to transport of the holes out of the passivation layer and into the anode environment. The disclosure demonstrates that the addition of a surface modifying layer to the passivation layer can reduce the resistance of the passivation layer to the conduction of the holes out of the passivation layer. As a result, the photoanode can provide high levels of both hole conduction and corrosion resistance.

Figure 1A:
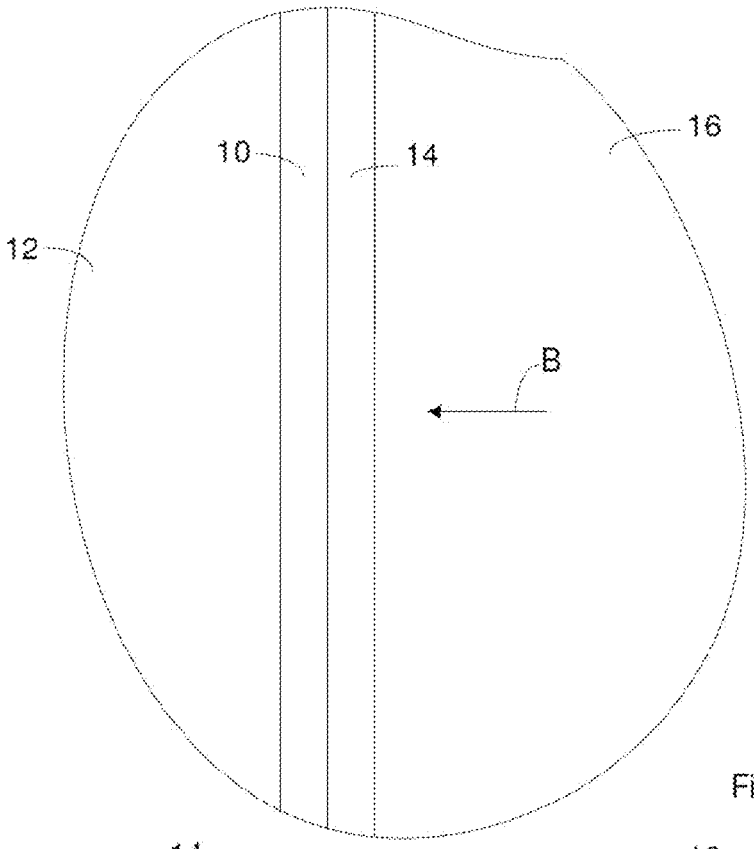
FIG. 1A is a cross section of a photoanode.
Figure 1B:
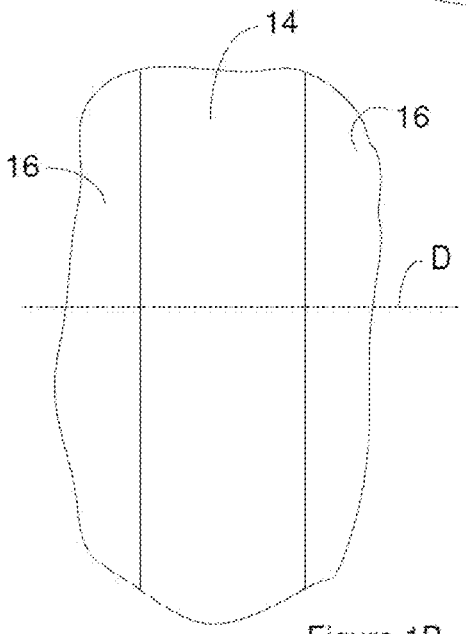
FIG. 1B is a sideview of the photoanode shown in FIG. 1A taken looking in the direction of the arrow labeled B in FIG. 1A.

FIG. 1A is a cross section of a photoanode. FIG. 1B is a sideview of the photoanode shown in FIG. 1A taken looking in the direction of the arrow labeled B in FIG. 1A. The photoanode includes a passivation layer 10 between an anode light absorber and a surface modifying layer 14. The passivation layer 10 and/or the surface modifying layer 14 can be solid. In some instances, the light-absorbing semiconductor is in direct physical contact with the surface-modifying layer 14 and the protective layer. The photoanode is positioned in an anode environment 16 that can be a liquid or a gas. In some instances, the anode environment 16 has a basic pH. For instance, the pH of the anode environment 16 can be greater than 8, 10, 13 or 14. In one example, the anode environment 16 is water with a pH greater than 8, 10, 12, or 14. Although the photoanode is disclosed in the context of a basic anode environment, the anode environment can be neutral or acidic depending on the application of the photoanode.

The passivation layer 10 prevents the anode environment 16 from contacting the anode light absorber. For instance, one or more variable selected from the material of the passivation layer 10, method of applying the passivation layer 10, and/or thickness of the passivation layer 10 can be selected such that the passivation layer 10 prevents the anode environment 16 from contacting the anode light absorber. In some instances, the passivation layer 10 is free of pinholes and/or other pores that would allow the anode environment 16 to contact the anode light absorber. Since the anode environment 16 does not contact the anode light absorber, the anode light absorber is not corroded by the anode environment 16.

The passivation layer 10 is more corrosion resistant than the anode light absorber. Corrosion of the anode light absorber is generally caused by the anode light absorber reacting with one or more components in the anode environment 16 selected from the group consisting of water, $O_2$ and $OH^-$. The corrosion reaction generally forms oxides of the anode light absorber. In some instances, the anode light absorber has a corrosion rate greater than 1 or 10 nm per minute in the anode environment while the passivation layer 10 has a corrosion rate less 1 nm per month in the anode environment.

The passivation layer 10 can be transparent or substantially transparent to light having the wavelength or range of wavelengths to which the photoanode is exposed during operation (the operational wavelength range). For instance, in some instances, the passivation layer 10 transmits more than 50%, 70%, or 90% of each wavelength within the operational range. Examples of suitable operational wavelength ranges include, but are not limited to, wavelengths greater than 50 nm, 250 nm, or 350 nm and/or less than 1100 nm, 1500 nm, or 2000 nm.

The passivation layer 10 is a hole conductor. In some instances, the passivation layer 10 includes defects that permit the passivation layer 10 to conduct the holes through defect-mediated conduction. In some instances, the passivation layer 10 would not conduct holes in the absence of these defects or would only be able to conduct holes through tunneling mechanisms rather than through defect mediated conduction. In some instances, the hole conductivity for the passivation layer 10 is greater than 0.01 Siemens.

In some instances, a passivation layer 10 that conducts holes through defect mediated conduction may be preferable to other mechanisms because defect mediated conduction has a reduced dependency on the thickness when compared to other mechanisms. For instance, a passivation layer 10 that relies on tunneling can stop conducting holes as the thickness increases. In some instances, the thickness of the passivation layer 10 is greater than 0.1 nm, or 1 nm and/or less than 3 nm, 10 nm, or 100 nm. A thicker passivation layer 10 may be desirable as it can reduce the opportunities for the anode environment 16 to contact that anode light absorber. Suitable methods for forming the passivation layer 10 on the anode light absorber include, but are not limited to, atomic layer deposition, sputtering, evaporation, and Successive Ionic Layer Adsorption and Reaction (SILAR).

In some instances, the desired characteristics for the passivation layer 10 can be achieved with a metal oxide or with combinations of metal oxides. Accordingly, the passivation layer 10 can include, consist of, or consist essentially of one or more metal oxides. A metal oxide includes or consists of metal elements and oxygen. For instance, a metal oxide can include one or more metal elements and oxygen, two or metal elements and oxygen, three or metal elements and oxygen, or four or more metal elements and oxygen. Suitable examples of metal oxides that can be included in the passivation layer 10 include, but are not limited to, $TiO_2$, $SrTiO_3$, $SnO_2$, $K_2Ti_2O_5$, $K_2Ti_4O_9$, $BaTiO_3$, $PbTiO_3$, $ZrO_2$, $HfO_2$, $SnO_2$, $In_2O_3$, $FeO_x$, $MnO_x$, $NiO_x$, $CoO_x$, $WO_3$, ZnO, $Ta_2O_5$, $NbO_x$, $Al_2O_3$, MgO, $SiO_2$, and $BiO_x$ where x is greater than or equal to 1 and/or less than or equal to 2.

The passivation layer 10 can optionally be doped. In some instances, the passivation layer is doped such that the dopant can be the source of the defects in the passivation layer 10 that allow for the defect-mediated conduction. In some instances, the dopant concentration is greater than $10^{13}$ or $10^{16}$ $cm^{-3}$. Examples of suitable dopants include, but are not limited to, extrinsic impurities like Ni, Co, Fe, W, Cr, Ir, Ce, Na, Ca, Li, C, N, and intrinsic impurities like $Ti^{3+}$ and oxygen vacancies. In some instances, the passivation layer 10 includes, consists of, or consists essentially of one or more metal oxides and one or more dopants. In one example, the passivation layer 10 includes, consists of, or consists essentially of one or more metal oxides selected from a group consisting of $TiO_2$, $SrTiO_3$, $SnO_2$, $K_2Ti_2O_5$, $K_2Ti_4O_9$, $BaTiO_3$, $PbTiO_3$, $ZrO_2$, $HfO_2$, $SnO_2$, $In_2O_3$, $FeO_x$, $MnO_x$, $NiO_x$, $CoO_x$, $WO_3$, ZnO, $Ta_2O_5$, $NbO_x$, $Al_2O_3$, MgO, $SiO_2$, and $BiO_x$ where x is greater than or equal to 1 and/or less than or equal to 2 and one or more dopants selected from the group consisting of Ni, Co, Fe, W, Cr, Ir, Ce, Na, Ca, Li, C, N, $Ti^{3+}$, and oxygen vacancies.

The passivation layer 10 can conduct holes from the anode light absorber to the surface of the passivation layer 10. However, there appears to be an energy barrier to the holes entering the anode environment 16 directly from the passivation layer 10. As a result, the energy barrier slows or stops the holes from engaging in oxidation reactions at the surface of the passivation layer 10. Surprisingly the surface modifying layer 14 can permit charge transfer from the passivation layer 10 into the surface modifying layer 14 and/or charge transfer from the passivation layer 10, through the surface modifying layer 14 into a material that contacts the surface modifying layer 14. For instance, the resistance of the passivation layer 10 to transporting holes into the surface-modifying layer 14 can be lower than the resistance of the passivation layer 10 to transporting the holes into the anode environment 16. Further, the surface-modifying layer 14 can readily transport the holes from within the surface-modifying layer 14 into a material that contacts the surface modifying layer 14. Examples of materials that can contact the surface-modifying layer 14 can be the anode environment 16 or other materials such as oxidation catalysts (discussed below). Accordingly, the surface-modifying layer 14 permits the holes generated within the anode light absorber to readily take part in oxidation reactions at the surface of the photoanode and/or with components in the anode environment 16. Without being bound to theory, the charge transfer that is permitted by the surface modifying layer 14 is believed to be a result of the surface modifying layer 14 inducing ohmic electrical contacts with defect states that exist within the bandgap of the passivation layer 10. It is also possible that physical intermixing of surface modifying layer and the passivation layer at the interface between these materials plays a role in inducing ohmic electrical contacts with defect states that exist within the bandgap of the passivation layer 10.

One way to measure the degree of resistance of the passivation layer 10 to transporting holes out of the passivation layer 10 is anodic current. Since the surface-modifying layer 14 allows holes to be transported across the surface of the passivation layer 10, the surface-modifying layer 14 decreases the electrical resistance of the passivation layer 10 to the passage of anodic current through the passivation layer 10. For instance, the electrical resistance to passage of an anodic current through the passivation layer 10 is less when the surface modifying layer 14 is in place on the passivation layer 10 than when the passivation layer 10 is not in place. As a result, an anodic current can be used to identify and study materials for the surface-modifying layer 14. An anodic current is current resulting from a flow of electrons into the photoanode from a liquid solution. The performance of a proposed surface-modifying layer 14 can be tested by placing the passivation layer 10 and the proposed surface-modifying layer 14 on a substrate that readily conducts holes such as degenerately doped $p^+$-Si. The result can be immersed in a solution that readily conducts holes from the surface-modifying layer 14 into the solution. A voltage can then be applied between the substrate and the solution so as to generate an anodic current through the combination of the passivation layer 10 and surface-modifying layer 14. A positive anodic current shows conduction of holes across the combination of the passivation layer 10 and surface modifying layer 14 and accordingly shows conduction of holes across the surface of the passivation layer 10 into the surface-modifying layer 14. This result can be compared to results generated using the same technique but with using only passivation layer 10 by itself (i.e., immersing in the solution the substrate and the passivation layer 10 without the surface modifying layer 14). As shown below, for a given applied voltage, the surface-modifying layer 14 increases the level of anodic current that is achieved and accordingly reduces the electrical resistance of the passivation layer 10 to the conduction of holes.

In some instances, the photoanode includes a surface modifying layer 14 where an applied voltage of at least 0.3 V vs. standard calomel electrode (SCE) results in an anodic current density that is at least 10 $mA/cm^2$, 20 $mA/cm^2$, and/or 35 $mA/cm^2$ higher than the anodic current density achieved with the passivation layer 10 alone (i.e., without the surface modifying layer 14) and/or the resulting anodic current density is at least 5, 10, 100, 1000, or even 10,000 times higher than the anodic current density achieved with the passivation layer 10 alone. Additionally or alternately, in some instances, the passivation layer 10 is selected such that when a voltage of 0.5 V vs. SCE is applied to the passivation layer 10 without the surface modifying layer 14, the resulting anodic current density is less than or equal to 1 $mA/cm^2$, 0.5 $mA/cm^2$, 0.1 $mA/cm^2$, 0.05 $mA/cm^2$, 0.01 $mA/cm^2$, or even less than 0 $mA/cm^2$.

Suitable solutions for the generation of anodic currents include, but are not limited to, aqueous solutions that include one or more redox couples that readily react with available holes at the surface of a passivation layer 10 and/or surface modifying layer 14. In some instances, the redox couple has a well-defined Nernstian potential with exchange current density of at least 1 mA $cm^{-2}$ for typical electrode materials such as platinum, gold, copper and/or the surface modifying layer 14. A suitable redox couple includes, but is not limited to, (ferri-/ferro-cyanide) redox couples such as $[Fe(CN)_6]^{3-}/[Fe(CN)_6]^{4-}$. In some instances, the solution includes, consists of, or consists essentially of 0.05/0.35 M $[Fe(CN)_6]^{3-}/[Fe(CN)_6]^{4-}$ in water.

The contact between the passivation layer 10 and the surface-modifying layer 14 can be an ohmic contact. In some instances, it may be possible to achieve similar results with a rectifying contact but an ohmic contact is preferred. The material for the surface-modifying layer 14 can penetrate into the passivation layer 10. For instance, at a distance of at least 2 nm, 3 nm, or 4 nm into the passivation layer 10, the molar % of the passivation layer 10 that is the material for the surface modifying layer 14 can exceed 15%, 30%, or 50%. In one example, at a distance of at least 3 nm into the passivation layer 10, the molar % of the passivation layer 10 that is the material for the surface modifying layer 14 exceeds 50%.

Suitable methods of forming the surface modifying layer 14 on the passivation layer 10 include, but are not limited to, chemical vapor deposition, sputtering, electron-beam evaporation, chemical bath deposition, electroplating, sol gel deposition, electrodeposition, electroless deposition, and atomic layer deposition. Atomic layer deposition has proven effective at achieving the desired level of penetration of the material for the surface-modifying layer 14 into the passivation layer 10.

The surface modifying layer 14 can include, consist of, or consist essentially of one or more components selected from the group consisting of transition metal elements, metal oxides that include one or more transition metals, nitrides that include one or more transition metals, and oxynitrides that include one or more transition metals. In some instances, the surface modifying layer 14 can include, consist of, or consist essentially of one or more components selected from the group consisting of elemental Ni, Co, Fe, Mn, Au, Ag, Ir, Ru, Rh, W, Ti, oxides that include or consist of one or more items selected from the group consisting of Ni, Co, Fe, Mn, Au, Ag, Ir, Ru, Rh, W, Ti, nitrides that include or consist of one or more items selected from the group consisting of Ni, Co, Fe, Mn, Au, Ag, Ir, Ru, Rh, W, Ti, and oxynitrides that include or consist of one or more items selected from the group consisting of Ni, Co, Fe, Mn, Au, Ag, Ir, Ru, Rh, W, Ti.

As noted above, the anode light absorber absorbs light within the operational wavelength range. In some instances, the passivation layer 10 and/or the surface modifying layer 14 are solid. Suitable materials for the anode light absorber include, but are not limited to, semiconductors. In some instances, the anode light absorber 12 is a solid. Suitable semiconductors for the anode light absorber include, but are not limited to, $TiO_2$, $CaTiO_3$, $SrTiO_3$, $Sr_3Ti_2O_7$, $Sr_4Ti_3O_{10}$, $Rb_2La_2Ti_3O_{10}$, $Cs_2La_2Ti_3O_{10}$, $CsLa_2Ti_2NbO_{10}$, $La_2TiO_5$, $La_2Ti_3O_9$, $La_2Ti_2O_7$, $La_2Ti_2O_7$:Ba, $KaLaZr_{0.3}Ti_{0.7}O_4$, $La_4CaTi_5O_{17}$, $KTiNbO_5$, $Na_2Ti_6O_{13}$, $BaTi_4O_9$, $Gd_2Ti_2O_7$, $Y_2Ti_2O_7$, $ZrO_2$, $K_4Nb_6O_{17}$, $Rb_4Nb_6O_{17}$, $Ca_2Nb_2O_7$, $Sr_2Nb_2O_7$, $Ba_5Nb_4O_{15}$, $NaCa_2Nb_3O_{10}$, $ZnNb_2O_6$, $Cs_2Nb_4O_{11}$, $La_3NbO_7$, $Ta_3O_5$, $KsPrTa_5O_{15}$, $K_3Ta_3Si_2O_{13}$, $K_3Ta_3B_2O_{12}$, $LiTaO_3$, $KTaO_3$, $AgTaO_3$, $KTaO_3$:Zr, $NaTaO_3$:La, $NaTaO_3$:Sr, $Na_2Ta_2O_6$, $CaTa_2O_6$, $SrTa_2O_6$, $NiTa_2O_6$, $Rb_4Ta_6O_{17}$, $Ca_2Ta_2O_7$, $Sr_2Ta_2O_7$. $K_2SrTa_2O_7$, $RbNdTa_2O_7$, $H_2La_{2/3}Ta_2O_7$, $K_2Sr_{1.5}Ta_3O_{10}$, $LiCa_2Ta_3O_{10}$, $KBa_2Ta_3O_{10}$, $Sr_5Ta_4O_{15}$, $Ba_2Ta_4O_{15}$, $H_{1.8}Sr_{0.81}Bi_{0.19}Ta_2O_7$, Mg—Ta Oxide, $LaTaO_4$, $LaTaO_7$, $PbWO_4$, $RbWNbO_6$, $RbWTaO_6$, $CeO_2$:Sr, $BaCeO_3$, $NaInO_2$, $CaIn_2O_4$, $SrIn_2O_4$, $LaInO_3$, $Y_xIn_{2-x}O_3$, $NaSbO_3$, $CaSb_2O_6$, $Ca_2Sb_2O_7$, $Sr_2Sb_2O_7$, $Sr_2SnO_4$, $ZnGa_2O_4$, $Zn_2GeO_4$, $LiInGeO_4$, $Ga_2O_3{}^{b}$, $Ga_2O_3$:$Zn^{c}$, $Na_2Ti_3O_7$, $K_2Ti_2O_5$, $K_2Ti_4O_9$, $Cs_2Ti_2O_5$, $H^+$—$Cs_2Ti_2O_5$, $Cs_2Ti_5O_{11}$, $Cs_2Ti_6O_{13}$, $H^+$—$CsTiNbO_5$, $H^+$—$CsTi_2NbO_7$, $SiO_2$-pillared $K_2Ti_4O_9$, $SiO_2$-pillared $K_2Ti_{2.7}Mn_{0.3}O_7$, $Na_2W_4O_{13}$, $H^+$—$KLaNb_2O_7$, $H^+$—$RbLaNb_2O_7$, $H^+$—$CsLaNb_2O_7$, $H^+$—$KCa_2Nb_3O_{10}$, $SiO_2$-pillared $KCa_2Nb_3O_{10}$, ex-$Ca_2Nb_3O_{10}/K^+$ nanosheet[4)], Restacked ex-$Ca_2Nb_3O_{10}/Na^+$, $H^+$—$RbCa_2Nb_3O_{10}$, $H^+$—$CsCa_2Nb_3O_{10}$, $H^+$—$KSr_2Nb_3O_{10}$, $H^+$—$KCa_2NaNb_4O_{13}$. $Bi_2W_2O_9$, $Bi_2Mo_2O_9$, $Bi_4Ti_3O_{12}$, $BaBi_4Ti_4O_{15}$, $Bi_3TiNbO_9$, $PbMoO_4$, $(NaBi)_{0.5}MoO_4$, $(AgBi)_{0.5}MoO_4$, $(NaBi)_{0.5}WO_4$, $(AgBi)_{0.5}WO_4$, $Ga_{1.14}In_{0.86}O_3$, β-$Ga_2O_3$, $Ti_{1.5}Zr_{1.5}(PO_4)_4$, $WO_3$, $Bi_2WO_6$, $Bi_2MoO_6$, $Bi_2Mo_3O_{12}$, $Zn_3V_2O_8$, $Na_{0.5}Bi_{1.5}VMoO_8$, $In_2O_3(ZnO)_3$, $SrTiO_3$:Cr/Sb, $SrTiO_3$:Ni/Ta, $SrTiO_3$:Cr/Ta, $SrTiO_3$:Rh, $CaTiO_3$:Rh, $La_2Ti_2O_7$:Cr, $La_2Ti_2O_7$:Fe, $TiO_2$:Cr/Sb, $TiO_2$:Ni/Nb, $TiO_2$:Rh/Sb, $PbMoO_4$:Cr, $RbPb_2Nb_3O_{10}$, $PbBi_2Nb_2O_9$, $BiVO_4$, $BiCu_2VO_6$, $BiZn_2VO_6$, $SnNb_2O_6$, $AgNbO_3$, $Ag_3VO_4$, $AgLi_{1/3}Ti_{2/3}O_2$, $AgLi_{1/3}Sn_{2/3}O_2$, $LaTiO_2N$, $Ca_{0.25}La_{0.75}TiO_{2.25}N_{0.75}$, TaON, $Ta_3N_5$, $CaNbO_2N$, $CaTaO_2N$, $SrTaO_2N$, $BaTaO_2N$, $LaTaO_2N$, $Y_2Ta_2O_5N_2$, $TiN_xO_yF_z$ where x is greater than or equal to 0 and/or less than or equal to 1, y is greater than or equal to 0 and/or less than or equal to 2, and z is greater than or equal to 0 and/or less than or equal to 3, $Sm_2Ti_2O_5S_2$, La—In oxysulfide, GaAs, GaP, $GaAs_xP_{1-x}$, $Al_xGa_{1-x}$ where x is greater than or equal to 0 and/or less than or equal to 1, As, $Al_xGa_{1-x}As_yP_{1-y}$ where x is greater than or equal to 0 and/or less than or equal to 1 and y is greater than or equal to 0 and/or less than or equal to 1, $In_xGa_{1-x}As$ where x is greater than or equal to 0 and/or less than or equal to 1, $In_xGa_{1-x}P$ x is greater than or equal to 0 and/or less than or equal to 1, $In_xGa_{1-x}As_yP_{1-y}$ where x is greater than or equal to 0 and/or less than or equal to 1 and y is greater than or equal to 0 and/or less than or equal to 1, $Al_xIn_{1-x}As_yP_{1-y}$ where x is greater than or equal to 0 and/or less than or equal to 1 and y is greater than or equal to 0 and/or less than or equal to 1, $Al_xGa_{1-x}As_yN_zP_{1-y-z}$ where x is greater than or equal to 0 and/or less than or equal to 1 and y is greater than or equal to 0 and/or less than or equal to 1, and z is greater than or equal to 0 and/or less than or equal to 1-y, $In_xGa_{1-x}As_yN_zP_{1-y-z}$ where x is greater than or equal to 0 and/or less than or equal to 1 and y is greater than or equal to 0 and/or less than or equal to 1, and z is greater than or equal to 0 and/or less than or equal to 1-y, $Zn_3P_2$, $Zn_3S_2$, and $ZnP_xS_{1-x}$ where x is greater than or equal to 0 and/or less than or equal to 2/3. Additionally or alternately, suitable materials for the anode light absorber include, but are not limited to, metallic materials consisting of Ti, Al, TiN, Ir, Pd, Pt, Ni, Ru, Ta, conductive oxides of Ir, Pd, Pt, Ni, Sn, Zn, indium or Al doped $SnO_2$, Al or Ga doped ZnO, metal silicides, metal germanides, metal nitrides and combinations thereof. In some instances, the materials are selected such that the bandgap for the surface modifying layer is larger than the bandgap of the anode light absorber and/or the bandgap for the surface modifying layer is larger than the bandgap of the anode light absorber.

In some instances, the anode light absorber is doped. For instance, the anode light absorber can be doped so as to include or consist of an n-type semiconductor. Additionally or alternately, the doping can be done to form one or more pn junctions within the anode light absorber. The doping can be done so holes excited within the anode light absorber are transported to the surface of the anode light absorber.

Figure 1C:
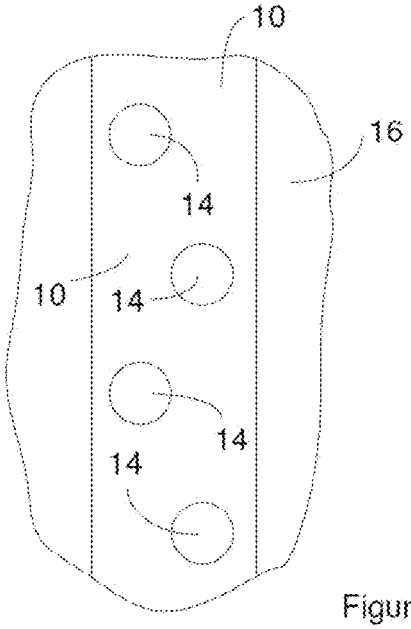
FIG. 1C is a sideview of a photoanode having a surface-modifying layer arranged in multiple discrete islands.

While FIG. 1B illustrates the surface modifying layer 14 as a continuous layer of material, the surface modifying layer 14 can be arranged in multiple discrete islands of material, in a grid pattern, or another pattern that leaves a portion of the passivation layer 10 exposed and/or uncovered by the surface modifying layer 14. For instance, FIG. 1C can represent a sideview of a photoanode having a surface-modifying layer 14 arranged in multiple discrete islands. When the surface modifying layers 14 are transparent or substantially transparent to the operational wavelength range, arranging the surface modifying layer 14 so at least a portion of the passivation layer 10 is uncovered by the surface modifying layer 14 can be optional; however, leaving a portion of the passivation layer 10 uncovered by the surface modifying layer 14 can allow the use of surface modifying layers 14 with low levels of transparency because the light can reach the anode light absorber through the uncovered regions of the passivation layer 10. When the surface-modifying layer 14 is arranged so the passivation layer 10 is uncovered by the surface-modifying layer 14, more than 30%, 60%, 90% or even 99% of the passivation layer 10 can be uncovered by the surface-modifying layer 14. Conversely, less than 1%, 10%, 40%, or 70% of the passivation layer 10 can be covered by the surface modifying layer 14. In one example, the surface modifying layer 14 is arranged in discrete islands with an average thickness in greater than or equal to 1 nm and/or less than 2 μm and/or a diameter, width, length, or other dimension that is in a range of 10 nm to 100 μm, and/or an average separation between adjacent islands greater than 1 μm or 10 μm and/or less than 250 μm, 1000 μm (pitch) or 10000 μm.

Figure 1D:
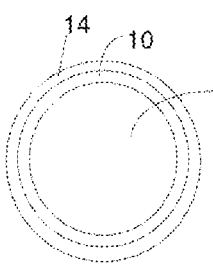
FIG. 1D is a cross section of a photoanode having a round cross section.
Figure 1E:
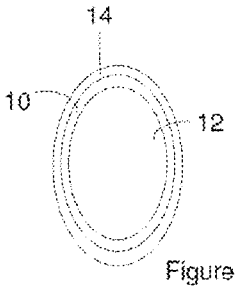
FIG. 1E is a cross section of a photoanode having an oval cross section.
Figure 1F:
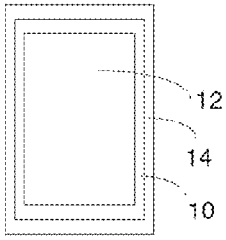
FIG. 1F is a cross section of a photoanode having a rectangular cross section.
Figure 1G:
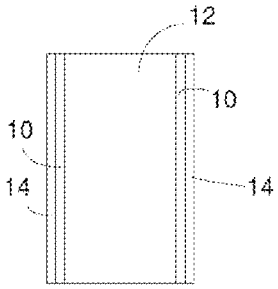
FIG. 1G is a cross section of a photoanode where a passivation layer is positioned on only a portion of the sides of an anode light absorber.

The above photoanodes can have a variety of different geometries as shown in FIG. 1D through FIG. 1G. FIG. 1D through FIG. 1G can each represents a cross section of the photoanode shown in FIG. 1B taken along the line that is labeled D in FIG. 1B. FIG. 1D through FIG. 1F respectively illustrate the photoanode with a round, oval, and rectangular cross section. Irregular cross sections are also possible. Although FIG. 1D through FIG. 1F illustrate the passivation layer 10 surrounding the anode light absorber, the passivation layer 10 can optionally be positioned on only a portion of the sides of the anode light absorber as shown in FIG. 1G; however, this arrangement may expose the anode light absorber to the anode environment 16. Alternately, this arrangement can permit the anode light absorber to be bonded directly to other materials such as cathode light absorbers 30.

Suitable shapes for the anode light absorbers 12 include, but are not limited to, porous materials, sheets, pillars, wires or drilled holes. In some instances, the anode light absorbers 12 are high aspect ratio structures such as cylinders, wires, or similar shapes. The aspect ratio is the ratio of the length of the semiconductor: width, diameter, or other cross sectional dimension of the semiconductor. Narrowing the width of the semiconductors reduces the distance that minority carriers must diffuse radially in order to reach the surface of the semiconductor. Accordingly, a suitable average width for the anode light absorbers 12 can be about the minority-carrier diffusion length of the material. In some instances, the average width for the anode light absorbers 12 is in a range of 100 nm-10 μm. High aspect ratio structures reduce the charge-carrier flux to the surface of the semiconductor. This reduced flux can reduce the turnover frequency required of any catalysts and can permit the use of more abundant and less active catalysts. Suitable average aspect ratios for the anode light absorbers 12 include, but are not limited to, ratios greater than 2:1, or 5:1, and/or less than 50:1, 100:1, or 200:1. In one example, the average aspect ratio for the anode light absorbers 12 is in a range of 44:1-70:1. Wire or cylinder shaped anode light absorbers 12 can support the above aspect ratios. The use of high aspect ratio structures is optional.

In some instances, one or more components of the surface modifying layer 14 acts as an oxidation catalyst. For instance, the surface-modifying layer 14 can include, consists of, or consists essentially of one or more components that catalyzes a reaction between the holes and one or more components of the anode environment 16. For instance, the one or more components of the surface-modifying layer 14 can catalyze water oxidation. Suitable oxidation catalysts for inclusion in a surface modifying layer 14 include, but are not limited to, $IrO_2$, $RuO_2$, $CO_3O_4$, $MnO_2$, $NiFeO_x$ where x is greater than 1 and/or less than 4, $IrRuO_y$ where y is greater than 1 and/or less than 4, $NiLaO_z$ where z is greater than 1 and/or less than 4, $BaSrCoFeO_z$, where z is greater than 1 and/or less than 4, platinum (Pt), FeOOH, NiOOH, and Co—Pi and mixtures thereof. One example of a suitable anode catalyst is 1:1 $IrO_2$:$RuO_2$. When the surface-modifying layer 14 includes one or more oxidation catalysts, the charge transfer that is enabled by the surface modifying layer 14 transfers the holes directly from the passivation layer 10 to the oxidation catalyst.

Figure 2A:
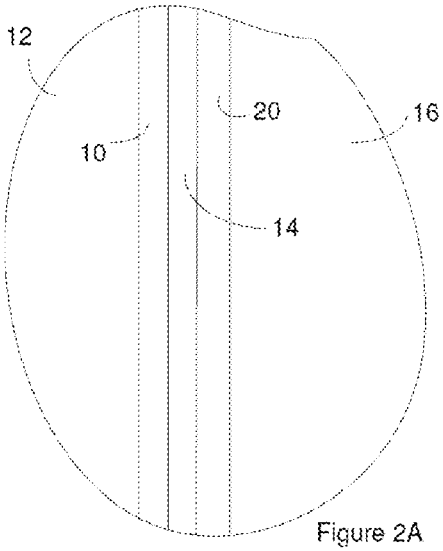
FIG. 2A is a cross section of a photoanode having a catalytic layer over a surface-modifying layer.
Figure 2B:
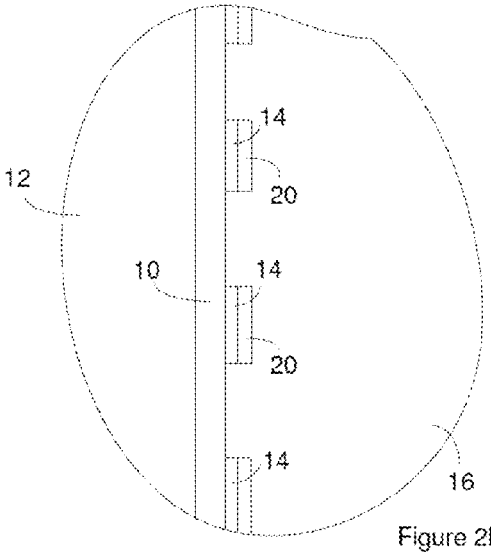
FIG. 2B is a cross section of a photoanode having a surface-modifying layer arranged over portions of a passivation layer such that one or more portions of the passivation layer are not under the surface-modifying layer.
Figure 2C:
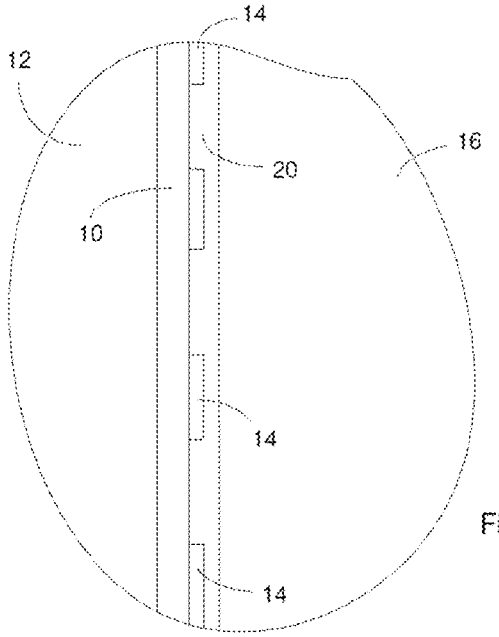
FIG. 2C is a cross section of a photoanode where a catalytic layer contacts both a passivation layer and a surface modifying layer.

Each of the above photoanodes can optionally include a catalytic layer 20. The catalytic layer 20 can be arranged such that all or a portion of the surface modifying layer 14 is between the passivation layer 10 and the surface modifying layer 14. In some instances, the catalytic layer 20 directly contacts the surface-modifying layer 14. For instance, FIG. 2A illustrates the photoanode of FIG. 1A but with a catalytic layer 20 over the surface modifying layer 14. When one or more portions of the passivation layer 10 are not covered by the surface-modifying layer 14, the catalytic layer 20 can be positioned over the surface-modifying layer 14 without being positioned over the passivation layer 10. For instance, FIG. 2B is a cross section of a photoanode having a surface-modifying layer 14 arranged such that one or more portions of the passivation layer 10 are exposed to the anode atmosphere. The catalytic layer 20 is positioned over the surface-modifying layer 14 such that the catalytic layer 20 does not contact the underlying passivation layer 10. For instance, when the surface-modifying layer 14 is arranged in a pattern such as islands, the catalytic layer 20 can be arranged in the same pattern but with the surface-modifying layer 14 between the catalytic layer 20 and the passivation layer 10. As a result, the holes from the passivation layer 10 are conducted through the surface-modifying layer 14 to the catalytic layer 20. Although FIG. 2B illustrates the catalytic layer 20 localized over the passivation layer 10, the catalytic layer 20 can optionally contact both the passivation layer 10 and the surface modifying layer 14 as illustrated in FIG. 2C. Arrangements where the catalytic layer 20 contacts the passivation layer 10 are particularly suitable for catalytic layers 20 that are transparent or substantially transparent to the light in the operational wavelength range.

The catalytic layer 20 can include, consist of, or consist essentially of one or more oxidation catalysts. In some instances, the catalytic layer 20 includes, consists of, or consists essentially of one or more components that catalyzes a reaction between the holes and one or more components of the anode environment 16. For instance, the one or more components can catalyze water oxidation. Suitable oxidation catalysts for inclusion in the catalytic layer 20 include, but are not limited to, inorganic catalysts. For instance, the catalytic layer 20 can include, consists of, or consists essentially of one or more components selected from the group consisting of elemental Ni, Co, Fe, Mn, Ir, Ru, Rh, Ta, W, Ti, oxides that include one or more items selected from the group consisting of Ni, Co, Fe, Mn, Ir, Ru, Rh, Ta, W, Ti, and molecular catalysts that include a metal center selected from a group consisting of Ir, Rh, Fe, Ni and Mn. Specific examples of suitable oxidation catalysts include, but are not limited to $IrO_2$, $RuO_2$, $Co_3O_4$, $MnO_2$, $NiFeO_x$ where x is greater than 1 and/or less than 4, $IrRuO_y$ where y is greater than 1 and/or less than 4, $NiLaO_z$ where z is greater than 1 and/or less than 4, $BaSrCoFeO_z$, where z is greater than 1 and/or less than 4, platinum (Pt), FeOOH, NiOOH, and Co—Pi and mixtures thereof. One example of a suitable anode catalyst is 1:1 $IrO_2$:$RuO_2$. Suitable methods of forming the catalytic layer 20 on the surface modifying layer 14, include, but are not limited to, sputtering, evaporation, electrodeposition and electroless deposition.

When the photoanode includes a catalyst layer, one or more components of the surface-modifying layer 14 can also act as an oxidation catalyst or none of the components in the surface-modifying layer 14 can act as an oxidation catalyst.

Figure 3:
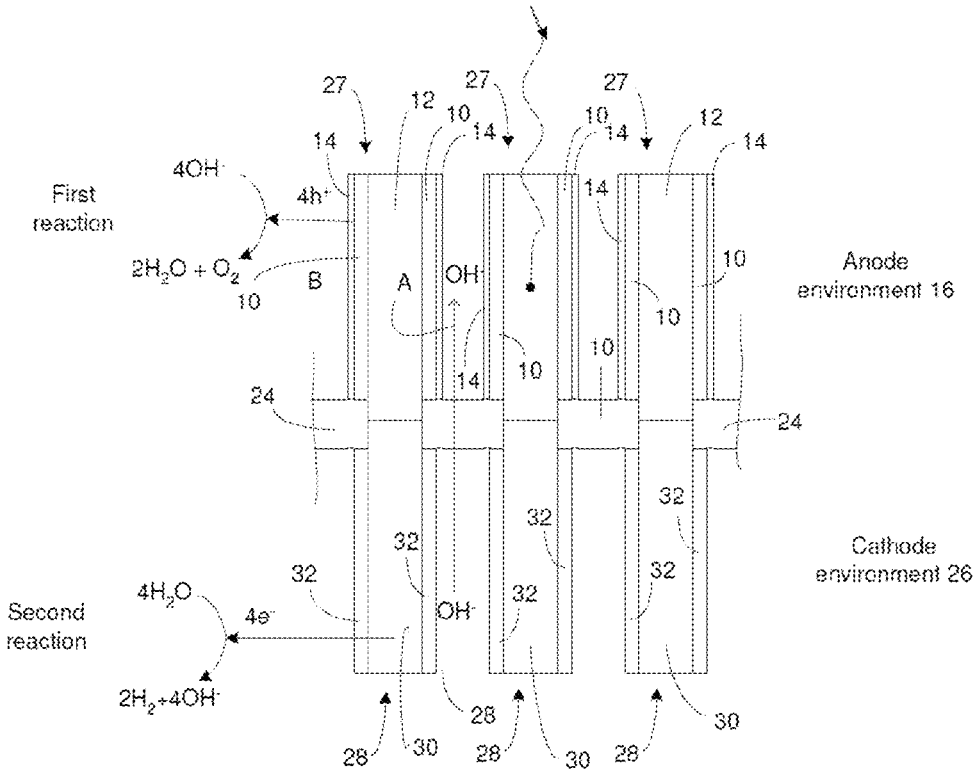
FIG. 3 is a cross section of a solar fuels generator.

The above photoanodes are suitable for use in a variety of applications such as solar fuels generators. FIG. 3 illustrates an example of a solar fuels generator that includes photoanodes constructed as disclosed above. The solar fuels generator includes a separator 24 that separates the anode environment 16 from a cathode environment 26. The cathode environment 26 can be a gas or a liquid. Photoanodes 27 and photocathodes 28 extend from opposing sides of the separator 24. In some instances, the spatial density of the photoanodes and/or photocathodes 28 is in a range of 0.005 to 30000 per $\mu cm^2$. Although not shown in FIG. 1, the separator 24 can surround each of the photoanodes and photocathodes 28. The photocathodes 28 include a cathode light absorber 30 selected to absorb light having wavelengths in the operational wavelength range. Suitable materials for the cathode light absorbers 30 include, but are not limited to, semiconductors.

In some instances, the anode light absorbers 12 are doped so electrons flow from the cathode light absorber 30 to the surface of the cathode light absorber 30. The dashed lines at the interface of the anode light absorber 12 and the cathode light absorber 30 illustrate an interface between the materials of the anode light absorber 12 and the cathode light absorber 30. The absorption of light by the cathode light absorber 30 and the anode light absorber 12 generates a photovoltage that drives electrolysis.

The separator 24 is ionically conductive. In some instances, the separator 24 conducts anions like hydroxide ions while concurrently being sufficiently nonconductive to the other components of the anode phase and the cathode environment 26 like $H_2$ and $O_2$ molecules that the anode phase and the cathode environment 26 remain separated from one another. Accordingly, the separator 24 can provide a pathway along which anions can travel from the cathode environment to the anode environment 26 without providing a pathway or a substantial pathway from the anode environment to the cathode environment 26 to one, two, or three entities selected from a group consisting of cations, nonionic atoms and nonionic compounds. In some instances, a suitable separator 24 can be a single layer or material or multiple layers of material. A suitable material includes, but is not limited to, gel polystyrene cross-linked with divinylbenzene with quaternary ammonium functional groups.

The photocathodes 28 include one or more photocathode catalysts 32. The photocathode catalyst 32 can be a reduction catalyst that catalyzes the second reaction. For instance, the photocathode catalyst 32 can catalyze proton reduction. The one or more photocathode catalysts 32 can be positioned on the cathode light absorber 30. In some instances, the one or more catalysts directly contact the cathode light absorber 30. Additionally or alternately, the one or more photocathode catalysts 32 coat the cathode light absorber 30 or are positioned in islands on the cathode light absorber 30. Suitable photocathode catalysts 32 include, but are not limited to, Pt, NiMo, and NiCo.

During operation, the solar fuels generator can be exposed to light such as sunlight, terrestrial solar illumination, AM1 solar radiation, or similar illumination having approximately 1 kilowatt per square meter of incident energy or less. The absorption of light by an anode light absorber 12 generates hole-electron pairs within the anode light absorber 12. An electrical field causes the holes to move to the surface of the anode light absorber 12, through the passivation layer 10 to the surface-modifying layer 14 that acts as an oxidation catalyst or through the surface-modifying layer 14 to a catalytic layer 20 (not illustrated). When the anode environment includes water, the surface modifying layer 14 and/or the catalytic layer 20 can catalyze the oxidation of the water in the anode environment. The oxidation of water is labeled reaction 1 in FIG. 3. The oxidation of water generates oxygen gas that can be stored for later use as fuel or that can be a byproduct of a fuel that is generated on the cathode side of the separator. The electrons excited in the anode light absorber 12 move toward the cathode light absorber 30 as a result of the electrical field.

The absorption of light by the cathode light absorber 30 generates hole-electron pairs within the cathode light absorber 30. An electrical field causes the electrons within the cathode light absorber 30 to move to the surface of the cathode light absorber 30 and then the surface of the photocathode catalyst 32 where they react with water to from hydroxide. The reduction of the water is labeled reaction 2 in FIG. 3. The reduction of water generates hydrogen gas that can optionally be stored for later use as fuel. The holes generated in the cathode light absorber 30 by the absorption of light move from the cathode light absorber 30 toward the anode light absorber 12 as a result of the electrical field and can recombine with the electrons from the anode light absorber 12.

The reduction of the water generates hydroxide ions. Since the separator 24 conducts anions like hydroxide ions, the hydroxide can travel through the separator 24 and enter the anode environment 26 in response to the resulting pH gradient. The movement of the hydroxide from the anode phase into the cathode environment 26 is shown by the arrow labeled A in FIG. 3.

Although the above discussion discloses using a solar fuels generator that generates oxygen gas, this device and/or processes can provide one or more components elected from the group consisting of hydroxide ions (basic environment), protons (when the anode environment is an acidic environment rather than basic and the separator is selected to conduct cations and/or protons), and electrons (from light absorbers) to the cathodic compartment. The cathode compartment of the solar fuels generator can be employed to generate solar fuels such as hydrogen or fuels that include hydrocarbons such as methane. Hydrocarbon fuels include or consists of carbon and hydrogen and may include or consist of carbon, hydrogen, and oxygen. These fuels can be generated by delivering an additional reactant to the photocathodes 28. For instance, the supply stream and/or cathode environment 26 can include one or more additional reactants.

EXAMPLES

Example 1

A passivation layer of $TiO_2$ was grown on $p^+$-Si (resistivity <0.002 Ω·cm) by atomic layer deposition and the result immersed in aqueous, one-electron, reversible $Fe(CN)_6^{3-/4-}$ (ferri-/ferro-cyanide) redox couples. The charger transfer between $TiO_2$ and ferri-/ferro-cyanide was expected to be facile. During cyclic voltammetry, a voltage was applied across the $p^+$-Si and the redox couples so as to drive electrical current through the passivation layer. The applied voltage and the resulting current were measured and the results are presented in FIG. 4A.

Figure 4A:
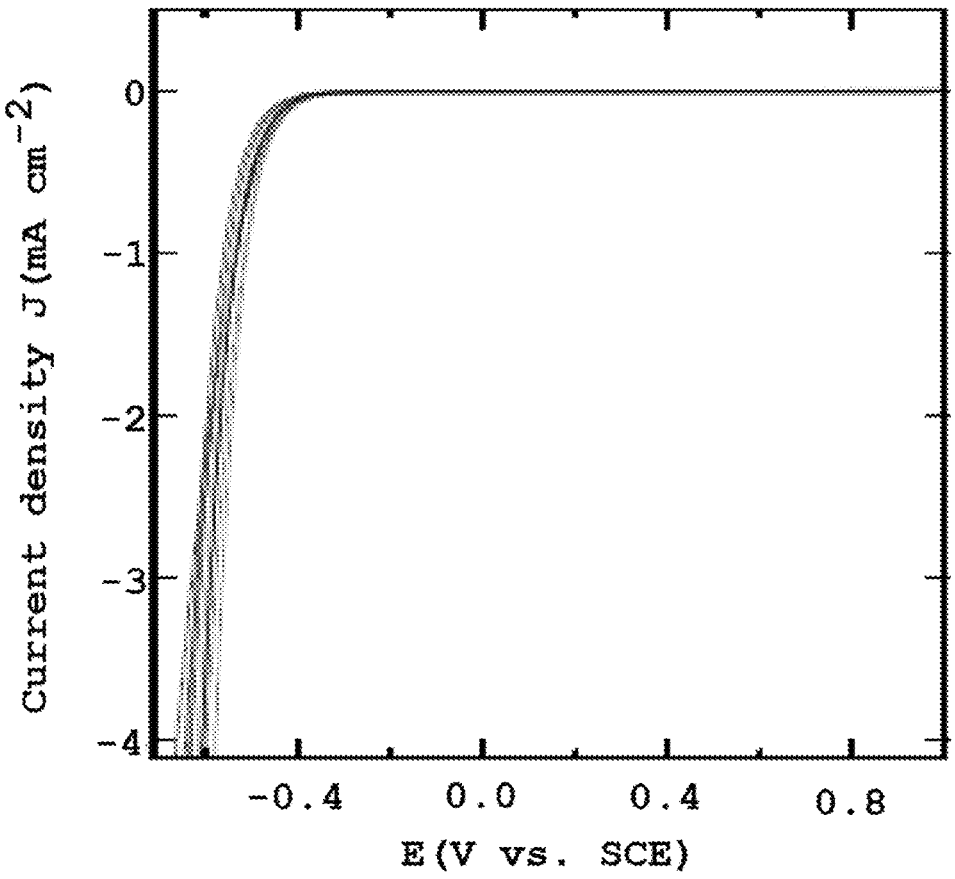
FIG. 4A illustrates the results of cyclic voltammetry of a passivation layer without a surface modification layer.

If hole conduction through the passivation layer were successful, one would expect to measure anodic (positive charge flow from $p^+$-Si to ferri-/ferro-cyanide) currents with $TiO_2$ on $p^+$-Si. As shown in FIG. 4A, the current density-potential (J-E) behavior (resistivity <0.002 Ω·cm) was rectifying: electrons were passed from semiconductors to liquid in dark, but hole were blocked with a maximum current density of $10^{-3}$~$10^{-2}$ mA·cm$^{-2}$. Various $TiO_2$ thicknesses of 250-3000 ALD cycles showed similar J-E behavior for as-grown $TiO_2$ on $p^+$-Si. Without $TiO_2$ layers, $p^+$-Si should exhibit Ohmic behavior to ferri-/ferro-cyanide.

The lack of anodic current in FIG. 4A illustrates that the passivation layer in unable to conduct holes across the surface at the interface of the passivation layer and the solution. Additionally, FIG. 4A shows that when an applied voltage of 0.3 V vs. SCE is applied to the passivation layer alone (i.e., without the surface modifying layer) so as to induce an anodic current through the passivation layer, the resulting anodic current density can be less or equal to 0.05 mA/cm$^2$, 0.01 mA/cm$^2$, or 0 mA/cm$^2$.

Example 2

Figure 4B:
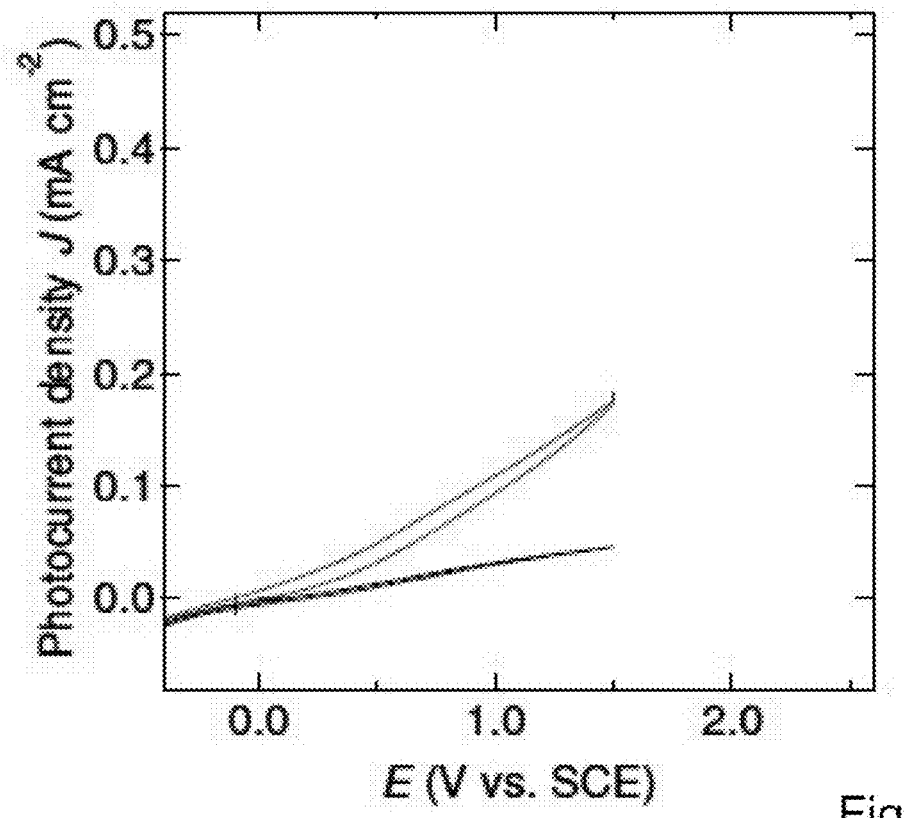
FIG. 4B illustrates the results of cyclic voltammetry performed on a passivation layer without a surface modification layer while exposed to simulated sunlight.

Devices were constructed with a passivation layer of $TiO_2$ grown to thicknesses varying over a range of 4 to 143 nm on n-Si (resistivity 2.06-2.18 Ω·cm) by atomic layer deposition and the result immersed in aqueous, one-electron, reversible $Fe(CN)_6^{3-/4-}$ (ferri-/ferro-cyanide) redox couples. During cyclic voltammetry, the result was exposed to simulated 1-sun illumination and the resulting photocurrent through the passivation layer was measured. The results of these measurements are presented in FIG. 4B. Similar to the results of FIG. 4A, anodic photocurrents were not achieved. Hole blocking was also observed for $TiO_2/p^+$-Si and $TiO_2$/n-Si in 1.0M KOH. A rectifying n-Si/$Fe(CN)_6^{3-/4-}$ junction without $TiO_2$ is expected to pass photoanodic currents with short-term stability; however, the tested system blocks hole conduction. As a result, the introduction of the passivation layer between the n-Si and the redox couple stopped hole conduction.

Example 3

Figure 4C:
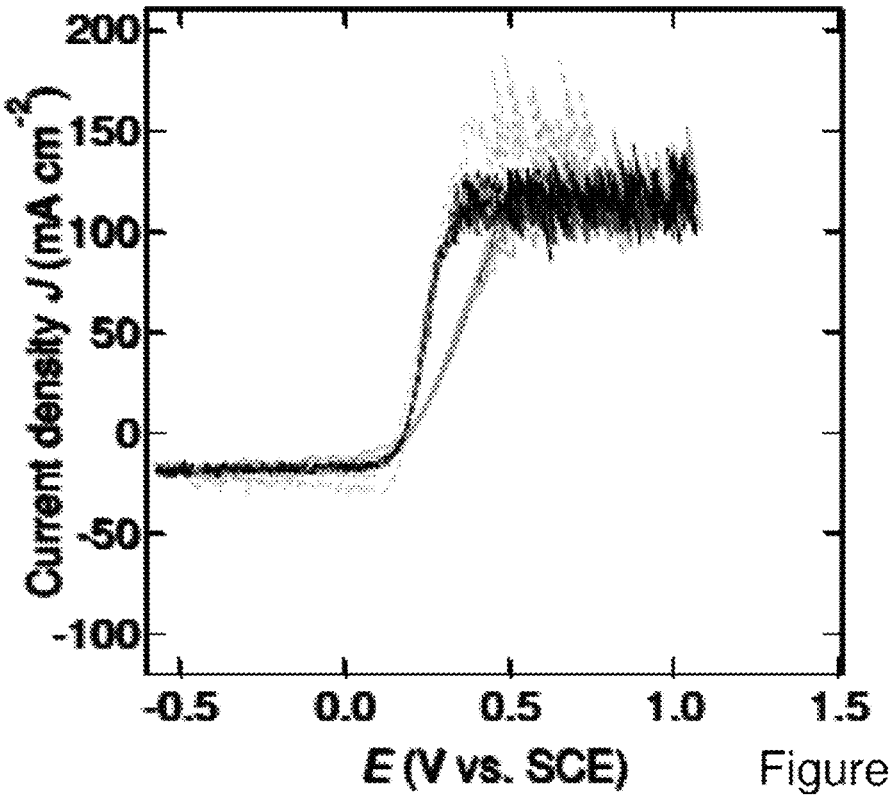
FIG. 4C illustrates the results of cyclic voltammetry of a passivation layer with a surface modification layer.

Devices were constructed with a passivation layer of $TiO_2$ grown to thicknesses varying over a range of 4 to 143 nm on $p^+$-Si (resistivity <0.002 Ω·cm) by atomic layer deposition. A nickel surface-modifying layer was deposited on the passivation layer. The surface-modifying layer was deposited using e-beam evaporation for a portion of the devices and using sputtering for another portion of the experiments. The resulting devices were immersed in aqueous, one-electron, reversible $Fe(CN)_6^{3-/4-}$ (ferri-/ferro-cyanide) redox couples. During cyclic voltammetry, a voltage was then applied across the $p^+$-Si and the redox couples so as to drive electrical current through the passivation layer and the surface-modifying layer. The resulting current was measured and the results for one of the devices shown in FIG. 4C. Ohmic conduction through the passivation layer was observed for through each of the passivation layers. FIG. 4C shows the conduction of carrier holes through passivation layer. There was slightly improved conductance as the thickness of the passivation layer increased. For instance, passivation layers of 68 to 143 nm thick $TiO_2$ showed Ohmic conduction with less resistance than a passivation layer of 4 to 44 nm thick $TiO_2$. Similar conduction behavior for majority-carrier holes was also observed for Ni/$TiO_2/p^+$-GaAs. The noisy upper and lower limit of FIG. 4C may indicate anodic limiting and cathodic limiting current densities that may be subject to diffusion and/or convention in an agitated solution.

A comparison of the results shown in FIG. 4C and FIG. 4A shows that the surface modifying layer reduces the resistance of the passivation layer to conduction of holes from within the passivation layer across the surface of the passivation layer. Further, note that anodic current was not achieved at all in FIG. 4A. As a result, the surface modification layer can actually make conduction of holes through the passivation layer possible when it is not previously possible without the surface modification layer. Further, a comparison of FIG. 4A and FIG. 4C shows that when an applied voltage of 0.3 V vs. SCE is applied to the photoanode so as to induce an anodic current, the resulting anodic current density can be at least 10 mA/cm$^2$, 20 mA/cm$^2$, and/or 35 mA/cm$^2$ higher than the anodic current density achieved without the surface modification layer and/or when an applied voltage of 0.3 V vs. SCE is applied to the photoanode so as to induce an anodic current, the resulting anodic current density can be at least 10, 100, 1000, or 10000 times higher than the anodic current density achieved with the passivation layer alone. Further, in some instances, the passivation layer is selected such that when a voltage of 0.3 V vs. SCE is applied to the passivation layer without the surface modifying layer, the resulting anodic current density is less than or equal to 0.05, 0.01, or 0 mA/cm$^2$.

Example 4

Figure 4D:
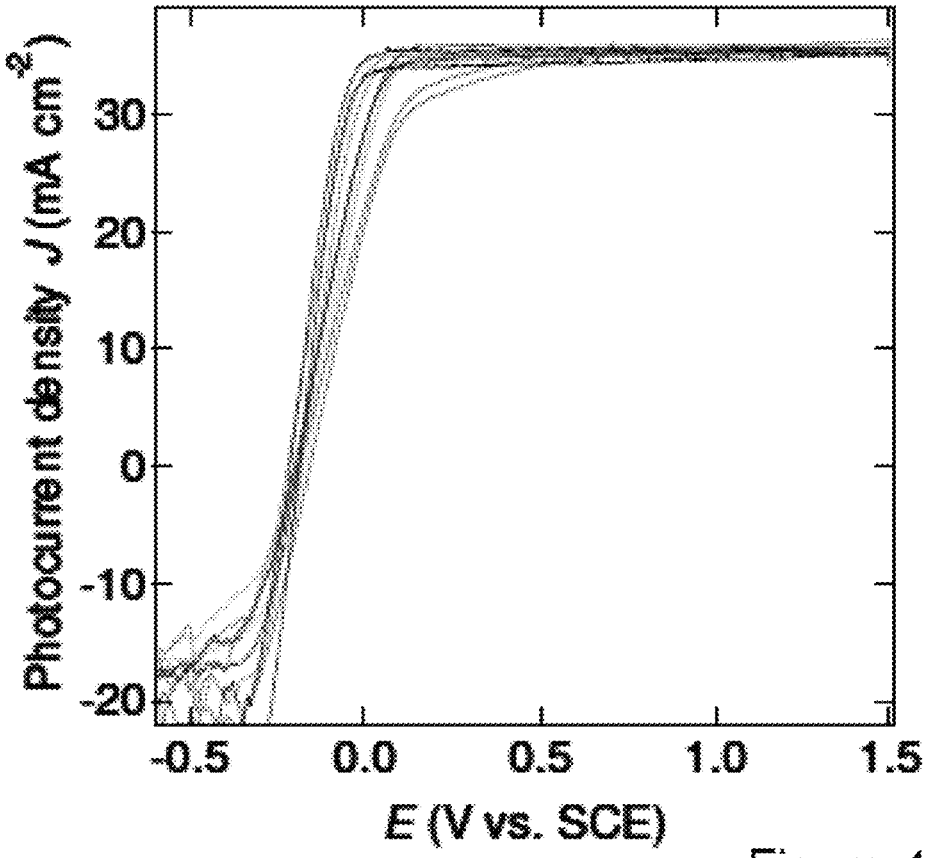
FIG. 4D illustrates the results of cyclic voltammetry performed on a passivation layer with a surface modification layer while exposed to simulated sunlight.

Devices were constructed with a passivation layer of $TiO_2$ grown to thicknesses varying over a range of 4 to 143 nm on n-Si (resistivity 2.06-2.18 Ω·cm) by atomic layer deposition. A nickel surface-modifying layer was deposited on devices in multiple arrays of discrete islands. The resulting devices were immersed in aqueous, one-electron, reversible $Fe(CN)_6^{3-/4-}$ (ferri-/ferro-cyanide) redox couples. Since the surface modifying layer was arranged in islands, portions of passivation layer are exposed and contact the aqueous, one-electron, reversible $Fe(CN)_6^{3-/4-}$ (ferri-/ferro-cyanide) redox couples. During cyclic voltammetry, the devices were exposed to simulated 1-sun illumination and the resulting current through the passivation layer and surface modifying layer were measured. The results of these measurements are presented in FIG. 4D. FIG. 4D shows anodic current.

The photoactivity for 4 to 143 nm thick $TiO_2$ on n-Si was also comparable. For instance, the photovoltages and photocurrent densities for all the thicknesses were −380 mV and 34.7±1.7 mA·cm$^{-2}$ under simulated 1.25-Sun illumination.

Example 5

The ability of the photoanode to operate in a strongly basic liquid was also studied. Devices were constructed with a passivation layer of $TiO_2$ grown to thicknesses varying over a range of 4-143 nm on $p^+$-Si (resistivity <0.002 Ω·cm) by atomic layer deposition. A nickel surface-modifying layer was deposited on the passivation layer. The resulting devices were immersed in 1M KOH (pH=13.7).

Figure 4E:
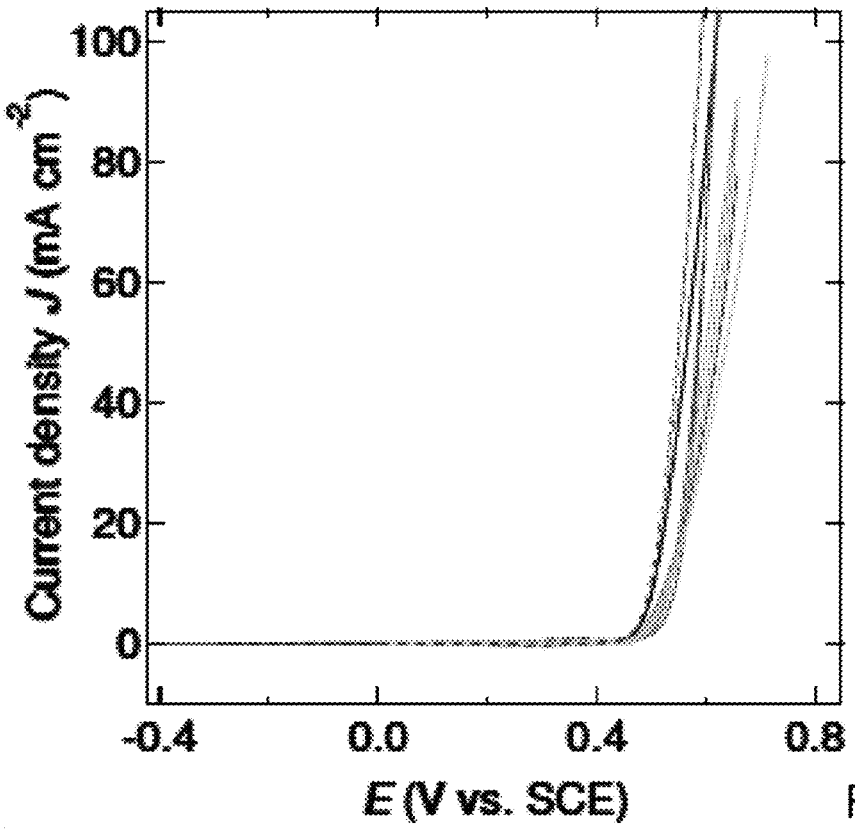
FIG. 4E illustrates the results of cyclic voltammetry performed on a passivation layer with a surface modification layer in a 1.0 M KOH solution.

During cyclic voltammetry, a voltage was then applied so as to drive electrical current through the passivation layer and the surface-modifying layer. The resulting current was measured and the results for one of the devices shown in FIG. 4E. FIG. 4E shows the conduction of carrier holes through the passivation layer and the surface-modifying layer. Similar conduction behavior for majority-carrier holes was also observed for Ni/$TiO_2$/$p^+$-GaAs in 1M KOH (pH=13.7).

Example 6

Figure 5:
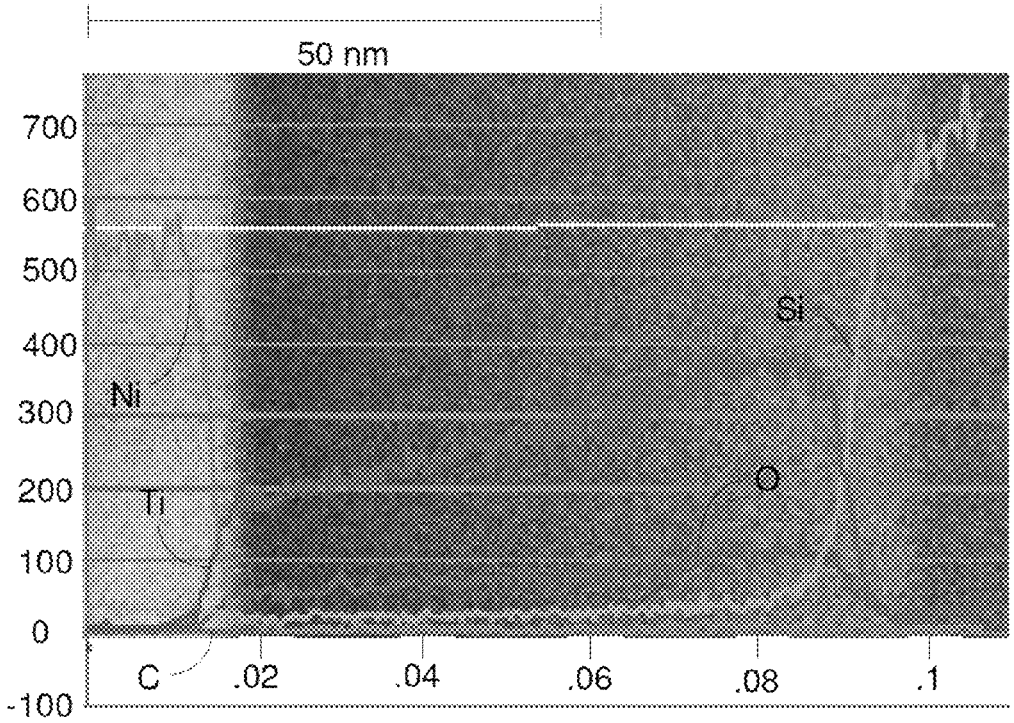
FIG. 5 is a scanning transmission electron microscopy of a Ni/$TiO_2$/Si structure with energy-dispersive x-ray spectroscopy (EDS).

A device was constructed with a passivation layer of $TiO_2$ grown on Si. A nickel surface-modifying layer was deposited on the device. FIG. 5 is a scanning transmission electron microscopy of the Ni/$TiO_2$/Si structure with energy-dispersive x-ray spectroscopy (EDS). The EDS line profiles of Ni, Ti and O across the same Ni/$TiO_2$ interface shows gradual decrease of Ni signal with gradual increase of Ti signal from bulk Ni film extending into $TiO_2$ film. This result shows intermixing of Ni and $TiO_2$ within a ~5.3 nm wide region. In particular, at a distance of 3 nm into the passivation layer, the passivation layer is about 50% of the material for the surface modifying layer and at a distance of 3 nm into the passivation layer, the passivation layer is about 50% of the material for the surface-modifying layer.

Other embodiments, combinations and modifications of this invention will occur readily to those of ordinary skill in the art in view of these teachings. Therefore, this invention is to be limited only by the following claims, which include all such embodiments and modifications when viewed in conjunction with the above specification and accompanying drawings.

The invention claimed is:

1. A device, comprising:

a photoanode that includes a passivation layer on a light absorber, the passivation layer being more resistant to corrosion than the light absorber; and the photoanode including a surface modifying layer on the passivation layer such that the passivation layer is between the light absorber and the surface modifying layer, the surface modifying layer reducing a resistance of the passivation layer to conduction of holes out of the passivation layer.

2. The device of claim 1, wherein the passivation layer and surface modifying layer are selected such that application of a voltage across the surface modifying and passivation layer so as to generate an anodic current through both the surface modifying layer and the passivation layer results in anodic current density that is higher for the modifying layer and the passivation layer than would result for application of the same voltage across the passivation layer without the surface modifying layer being on the passivation layer.

3. The device of claim 2, wherein when the applied voltage is 0.3 vs. SCE, the anodic current density for the combination of the surface modifying layer and the passivation layer is at least 10 mA/cm$^2$ higher than the current density for the passivation layer alone.

4. The device of claim 2, wherein when the applied voltage is 0.3 V vs. SCE, the anodic current density for the combination of the surface modifying layer and the passivation layer is at least 30 mA/cm$^2$ higher than the current density for the passivation layer alone.

5. The device of claim 4, wherein the application of the 0.3 V across the passivation layer without the surface modifying layer being on the passivation layer results in an anodic current density of 0 mA/cm$^2$.

6. The device of claim 1, wherein the surface modifying layer is in ohmic contact with the passivation layer.

7. The device of claim 1, wherein a material for the surface modifying layer mixes with the material of the passivation layer at an interface of the surface modifying layer and the passivation layer, the intermixing being such that at a distance of 3 nm into the passivation layer the molar % of the passivation layer that is the material for the surface modifying layer is at least 20%.

8. The device of claim 1, wherein the passivation layer includes a metal oxide.

9. The device of claim 1, wherein the passivation layer includes one or more components selected from a group consisting of $TiO_2$, $SrTiO_3$, $SnO_2$, $K_2Ti_2O_5$, $K_2Ti_4O_9$, $BaTiO_3$, $PbTiO_3$, $ZrO_2$, $HfO_2$, $SnO_2$, $In_2O_3$, $FeO_x$, $MnO_x$, $NiO_x$, $CoO_x$, $WO_3$, ZnO, $Ta_2O_5$, $NbO_x$, $Al_2O_3$, MgO, $SiO_2$, and $BiO_x$ where x is greater than or equal to 1 and/or less than or equal to 2.

10. The device of claim 1, wherein the surface modifying layer includes one or more components selected from the group consisting of elemental Ni, Co, Fe, Mn, Au, Ag, Ir, Ru, Rh, W, and Ti, oxides that include one or more items selected from the group consisting of Ni, Co, Fe, Mn, Au, Ag, Ir, Ru, Rh, W, and Ti, nitrides that include one or more items selected from the group consisting of Ni, Co, Fe, Mn, Au, Ag, Ir, Ru, Rh, W, and Ti, and oxynitrides that include one or more items selected from the group consisting of Ni, Co, Fe, Mn, Au, Ag, Ir, Ru, Rh, W, and Ti.

11. The device of claim 1, wherein an oxidation catalyst is on the surface modification layer such that the surface modification layer is between the oxidation catalyst and the passivation layer.

12. The device of claim 11, wherein the oxidation catalyst includes one or more components selected from the group consisting of elemental Ni, Co, Fe, Mn, Ir, Ru, Rh, Ta, W, and Ti, oxides that include one or more items selected from the group consisting of Ni, Co, Fe, Mn, Ir, Ru, Rh, Ta, W, and Ti.

13. The device of claim 1, wherein the surface modification layer is positioned on a surface of the passivation layer such that the surface modification layer is not positioned on portions of the surface.

14. The device of claim 13, wherein the surface modification layer is arranged in discrete islands on the passivation layer.

15. The device of claim 14, wherein the islands have a diameter dimension that is in a range of 11 nm to 100 μm, an average separation between the islands is in a range of 10 nm to 500 μm, and a thickness of each island of 1 nm-2 μm, the dimension being selected from the group consisting of the width, length, and diameter.

16. The device of claim 1, wherein an aspect-ratio for the light-absorber is in a range of 5:1 to 200:1.

17. The device of claim 1, wherein the photoanode is included in a solar fuels generator.

18. The device of claim 1, wherein the photoanode is immersed a liquid with a basic pH.

19. The device of claim 1, wherein passivation layer is arranged on the light absorber such that an environment in which the photoanode is located does not directly contact the light absorber.

20. The device of claim 1, wherein the passivation layer conducts holes through defect mediated conduction.

* * * * *